US008042452B2

(12) United States Patent
Hoernstein

(10) Patent No.: US 8,042,452 B2
(45) Date of Patent: Oct. 25, 2011

(54) LIFTING RAM FOR LIFTING PLATFORMS

(76) Inventor: Roland Hoernstein, Pfalzgrafenweiler (DE)

( * ) Notice: Subject to any disclaimer, the term of this patent is extended or adjusted under 35 U.S.C. 154(b) by 684 days.

(21) Appl. No.: 12/091,735

(22) PCT Filed: Oct. 25, 2006

(86) PCT No.: PCT/EP2006/067766

§ 371 (c)(1),
(2), (4) Date: May 13, 2008

(87) PCT Pub. No.: WO2007/048807

PCT Pub. Date: May 3, 2007

(65) Prior Publication Data

US 2008/0257652 A1 Oct. 23, 2008

(30) Foreign Application Priority Data

Oct. 25, 2005 (DE) ..... 10 2005 050 990

(51) Int. Cl.
*B66F 7/16* (2006.01)
*B66F 7/28* (2006.01)

(52) U.S. Cl. ..... 92/169.2; 92/117 R; 188/215

(58) Field of Classification Search ..... 92/117 R, 92/169.2, 169.4, 169.1; 187/215
See application file for complete search history.

(56) References Cited

U.S. PATENT DOCUMENTS

| | | | | |
|---|---|---|---|---|
| 5,143,179 | A * | 9/1992 | Hornstein | 187/205 |
| 5,740,887 | A * | 4/1998 | Unger et al. | 187/231 |
| 2003/0155561 | A1 | 8/2003 | Wanner | |

FOREIGN PATENT DOCUMENTS

| | | | |
|---|---|---|---|
| DE | 90 03 685.9 | | 7/1990 |
| DE | 297 15 619 | | 11/1997 |
| DE | 198 05 230 | | 8/1998 |
| DE | 19805230 | A1 * | 8/1998 |
| DE | 198 54 851 | | 5/2000 |
| DE | 200 15 831 | | 1/2001 |
| DE | 202 02 362 | | 5/2002 |
| DE | 101 11 324 | | 9/2002 |
| EP | 0 958 230 | | 2/1998 |

OTHER PUBLICATIONS

EPO Office Action, Appln. No. 06 807 543.1-1256 (4 pages), 2011.

* cited by examiner

*Primary Examiner* — Thomas E Lazo
(74) *Attorney, Agent, or Firm* — Hayes Soloway P.C.

(57) ABSTRACT

The invention relates to a lifting ram for lifting platforms, in particular for underfloor lifting platforms, comprising an inner tubular body and an outer body which is at least partially tubular and which at least partially surrounds the inner tubular body, wherein the outer tubular body and the inner tubular body are connected to one another at least in a force-fitting manner via connecting elements. The lifting ram is an extruded element at least in some sections.

42 Claims, 2 Drawing Sheets

LIFTING RAM FOR LIFTING PLATFORMS

Figure 1:
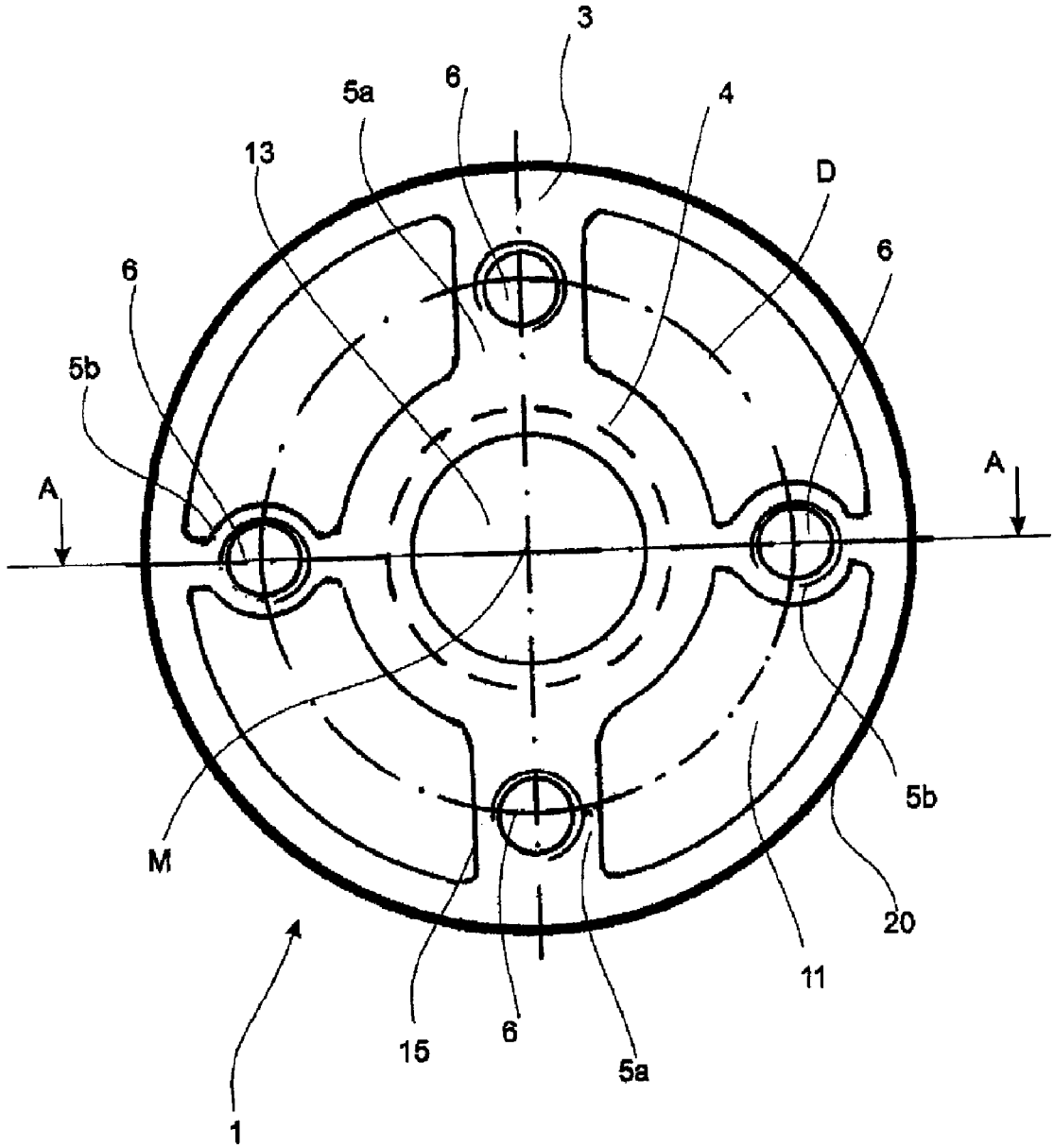

The present invention relates to a lifting ram. Such lifting rams are used in lifting devices such as lifting platforms for lifting vehicles to different heights and working positions in order to carry out maintenance and repair works.

The underfloor lifting platforms which form the present subject matter comprise at least one lifting ram which slides vertically through a guide and on which a load handling device is fixed. This load handling device engages under the vehicle. Such underfloor lifting platforms are installed in a garage floor.

Such lifting rams are known from the prior art. These lifting rams have a turned and polished surface, i.e. a precisely defined outer diameter and a high surface quality. It is known for example to electroplate the surface in order to protect it against corrosion. This production method is complicated and expensive, but has the advantage that precise guidance and bearing of the lifting ram is possible and in this way the guide length can be kept short.

It is also known from the prior art to form underfloor lifting platforms with reversing cylinders. Such an arrangement is disclosed for example in the German utility model G 90 03 685.9. The lifting ram disclosed therein has a precisely defined outer diameter with a high surface quality and electrochemical corrosion protection. However, the present invention is not limited to lifting platforms with reversing cylinders.

In addition to an outer tube, the lifting ram known from the prior art has an inner tube which in turn serves to accommodate a piston element. This outer tube and the inner tube are connected to one another via welded connections in the prior art. These welded connections are arranged for example at the upper end and at the lower end of the lifting ram. Due to these welds, the production of the lifting ram is complicated.

Lifting rams are mounted in a stable guide, in which they move up and down. Arranged in this guide are sealing elements which seal the outer diameter of the lifting ram. However, the sealing elements do not serve to seal the hydraulic medium of the drive hydraulics but rather to keep the lubricant located in the guide inside the lubrication chamber of the guide and to prevent surface water from being able to enter the lubrication chamber of the guide, for example during wet cleaning of the garage floor.

The object of the present invention is therefore to provide a lifting ram which can be produced more easily. This lifting ram should have a precisely defined outer diameter with a high surface quality and satisfactory corrosion protection.

The lifting ram according to the invention for lifting platforms, in particular for underfloor lifting platforms, comprises an inner tubular body and an outer body which is at least partially tubular and which at least partially surrounds the inner tubular body. The outer tubular body and the inner tubular body are connected to one another at least in a force-fitting manner and preferably materially via connecting elements. According to the invention, the lifting ram is an element which is extruded at least in some sections.

An element which is extruded at least in some sections is understood to mean that at least one section of the lifting ram is produced by an extrusion process. A tubular body is understood to mean a body having an essentially continuous cavity in its interior. Both the inner tubular body and the outer tubular body may have any cross sections, such as circular cross sections, polygonal cross sections, elliptical cross sections, combinations thereof and the like.

Preferably, the cross section of the outer tubular body and the cross section of the inner tubular body are matched to one another, i.e. for example both circular cross sections. However, it would also be possible to select different cross sections, for example a polygonal cross section for the outer tubular body and a circular cross section for the inner tubular body.

Preferably, the outer tubular body essentially completely surrounds the inner tubular body.

In a further preferred embodiment, the outer tubular body and the inner tubular body are formed as one piece. This means that at least that section of the lifting ram which comprises the outer and the inner tubular body is extruded, and particularly preferably the entire lifting ram is an extruded element.

By forming the lifting ram as an extruded element, production thereof can be simplified. A lifting device which comprises such a lifting ram can also be produced much more easily, and ideally consists of just two components, namely the lifting ram and a cover arranged opposite the latter. In addition, the extrusion process produces a permanent connection between the outer tubular body and the inner tubular body, so that the body as a whole has a high flexural strength and can be produced with little material and a low manufacturing complexity. Another advantage of extrusion is that the surface of the outer tubular body can be produced with a high quality. The same also applies in respect of the inner surface of the inner tubular body.

In a further preferred embodiment, a thread is arranged in at least one end section of the lifting ram. By means of this thread or a threaded bore, load handling devices can be fixed on the end sides of the lifting ram and in particular on the upper side thereof. Components which serve for example to prevent rotation and/or to prevent lowering can be screwed onto the underside of the lifting ram. Connecting elements which serve to ensure synchronisation in the case of lifting platforms with multiple rams can also be screwed on. In a further embodiment, a further lifting device for a free-wheel mechanism can be provided by means of corresponding threaded bores.

In a further preferred embodiment, the inner tubular body is suitable for accommodating a piston element and in particular a hydraulic cylinder. By means of this hydraulic cylinder, the lifting ram can be displaced in the longitudinal direction.

In a further preferred embodiment, a covering element is arranged at the upper end of the lifting ram, which covering element covers the lifting ram in an essentially gastight manner. In this way, the inner tubular body is securely closed in a fluid-tight manner. Preferably, a closable opening is arranged in the covering element. This closable opening serves for venting the inner tubular body or the hydraulic system.

In a further preferred embodiment, the inner tubular body has at least one essentially circumferential groove and preferably a plurality of circumferential grooves on its outer circumference in a lower region. These grooves are preferably arranged around the entire circumference and can be used as grooves for guide and sealing elements.

Preferably, a lateral opening is provided in the inner tube above the grooves. This opening serves as a hydraulic pressure connection, in order to be able to move the lifting ram up and down hydraulically. A medium is supplied to the inner tube through this opening. In a further preferred embodiment, the wall thickness of the inner tubular element is kept at such a thickness that the abovementioned circumferential grooves for the guide and sealing elements can be formed on the inner side of the inner tubular body.

In a further preferred embodiment, the outer surface of the lifting ram is electrochemically treated, for example anodised or hard-anodised or provided with a suitable coating. In this way, the corrosion resistance and wear resistance of the surface are increased. Another possibility is to coat the outer surface with a PTFE-containing plastic material in an adhering manner.

In a further preferred embodiment, at least one connecting element has a cavity extending in the longitudinal direction of the lifting ram. This cavity can also easily be produced by the extrusion process. In a further embodiment, all connecting elements have such cavities, or else two opposite connecting elements in a further embodiment. With particular preference, four connecting elements are provided which are distributed essentially uniformly in the circumferential direction of the tubular bodies.

Preferably, at least one cavity has an essentially circular profile. As a result of this profile, these cavities are particularly suitable as core holes for the abovementioned fixing thread.

Preferably, the connecting elements are formed in the manner of webs and in one particularly preferred embodiment extend essentially radially outwards from the inside.

In a further preferred embodiment, cavities are formed between the connecting elements. These cavities are arranged essentially uniformly in the circumferential direction and particularly preferably between the inner tubular body and the outer tubular body. This spacing can also be produced in a particularly simple manner by means of an extrusion process. On the whole, this spacing results in a frame which has a high flexural strength or torsion resistance.

In a further preferred embodiment, the outer tubular body has a smaller length than the inner tubular body. In this case, the outer tubular body and the inner tubular body end essentially at the same level as one another at the upper end of the lifting ram. However, the outer tubular body is preferably shortened with respect to the inner tubular body and particularly preferably is shortened to the level of the abovementioned hydraulic connection. In this way, access to the hydraulic connection is achieved in a particularly advantageous manner.

In a further preferred embodiment, the lifting ram has an outer cross section selected from a group of cross sections comprising circular cross sections, elliptical cross sections, polygonal cross sections, in particular rectangular cross sections, combinations thereof and the like. As mentioned above, both the outer tubular body and the inner tubular body can have these aforementioned cross sections.

The present invention furthermore relates to a lifting device and a lifting ram. Here, the lifting ram is arranged in a guide device at least in some sections. This guide device particularly preferably surrounds the lifting ram.

In a further preferred embodiment, a hydraulic cylinder is arranged in the inner tubular body. With particular preference, sealing elements are arranged in the abovementioned circumferential grooves of the inner tubular body. Furthermore, guide elements may be arranged in the circumferential grooves. Finally, it is also possible to provide sealing elements in some grooves and guide elements in other grooves.

The present invention furthermore relates to a lifting platform comprising at least one lifting device of the type described above. However, it is also possible to provide a plurality of such lifting devices, for example two main lifting devices and two free-wheel lifting devices arranged parallel thereto. Preferably, a load handling device is arranged on at least one lifting device and particularly preferably is securely connected to said lifting device.

The present invention also relates to a method for producing a lifting ram, in particular a lifting ram for lifting platforms. According to the invention, the lifting ram is produced at least partially by an extrusion process. Preferably, the lifting ram is produced entirely by an extrusion process. In a further preferred method, threads are subsequently formed in the lifting ram.

The lifting ram is preferably made of a metal, and particular preferably of aluminium.

Figure 2:
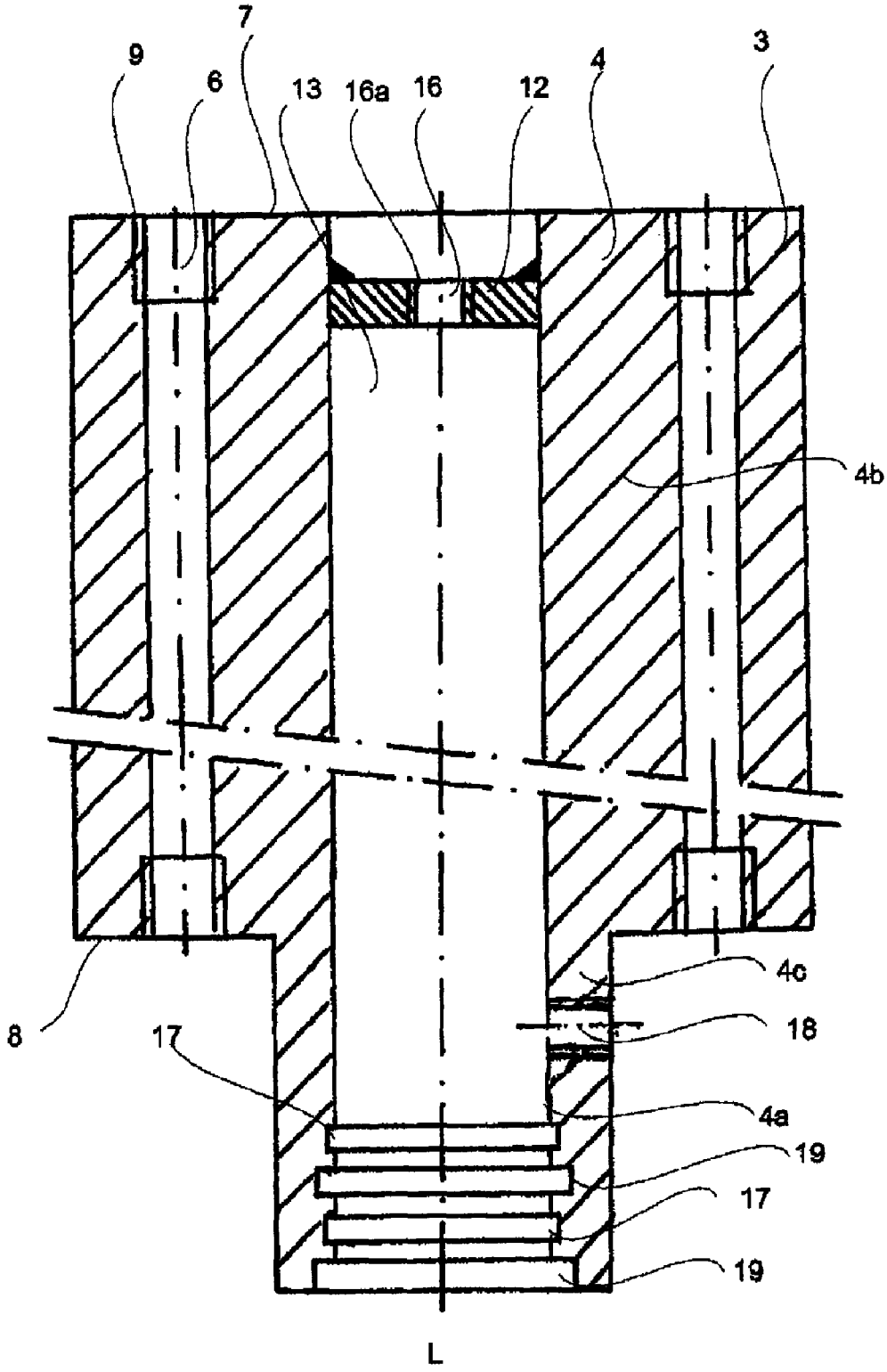

Further advantageous embodiments emerge from the appended drawings, in which:

FIG. 1 shows a schematic plan view of a lifting ram according to the invention, and FIG. 2 shows a side view of the lifting ram from FIG. 1.

FIG. 1 shows a schematic plan view (not to scale) of a lifting ram according to the invention. This lifting ram 1 comprises an inner tubular body 4 and an outer tubular body 3. In the embodiment 4 shown in FIG. 1, connecting elements 5*a*, 5*b* are arranged between this inner tubular body 4 and the outer tubular body 3.

As shown in FIG. 1, these connecting elements may both run outwards in an essentially straight line (5*a*) and have an outer profile in the shape of a segment of a circle (5*b*). In further embodiments, the connecting elements 5*a*, 5*b* are preferably either all formed with an essentially straight profile (5*a*) or else all formed with an outer circumference essentially in the shape of a segment of a circle (5*b*). Other geometric shapes for the connecting elements 5*a*, 5*b* are also conceivable.

The connecting elements 5*a*, 5*b* are produced by extrusion together with the inner tubular body 4 and the outer tubular body 3.

In the embodiment shown in FIG. 1, four such connecting elements 5*a*, 5*b* are provided which are distributed essentially uniformly in the circumferential direction. However, it would also be possible here to provide a different number of connecting elements 5*a*, 5*b*, such as 3, 5 or more for example.

Provided in the individual connecting elements 5*a*, 5*b* are cavities 6 which extend essentially fully in the longitudinal direction of the lifting ram. Here, the longitudinal direction runs essentially perpendicular to the plane of the figure. These cavities 6 can also be produced in the same extrusion process in which the whole extruded profile is produced.

Preferably, threads 9 are arranged in the cavities 6 in the upper end face 7 and the lower end face 8 of the lifting ram. These threads 9 are used for securely screwing further elements, such as load handling devices or the like, onto the upper side of the lifting ram. As already mentioned, devices for preventing rotation or other components can be screwed onto the lower end face 8.

Preferably, the respective fixing threads 9 on the upper side and on the lower side of the lifting ram lie on the same pitch circle diameter D, that is to say the individual cavities are in each case at the same distance from the centre point M of the lifting ram. Reference 13 denotes a cavity which is arranged within the inner tubular body 4.

In the embodiment shown here, the cavity 13 has an essentially circular profile. Running within this cavity is a hydraulic cylinder (not shown), by means of which the lifting ram can be raised or lowered.

Reference 11 denotes cavities which are likewise produced by extrusion between the inner tubular body 4 and the outer tubular body 3. In the embodiment shown here, a total of four such cavities 11 are formed.

Reference 20 denotes an outer surface of the lifting ram. In one preferred embodiment, this outer surface is electrolytically oxidised in order to improve the surface quality.

FIG. 2 shows a side view of the lifting ram from FIG. 1 along the line A-A in FIG. 1. It can be seen that the inner tubular body 4 has an upper section 4*b* and a lower section 4*c*. The upper section 4*b* has the same length L as the outer tubular body 3, which in this embodiment completely surrounds the inner tubular body 4. The upper tubular section 4*b* is adjoined by the lower section 4*c*. Provided in this lower section is an opening 18 which extends in the radial direction. This opening 18 serves as a hydraulic connection for supplying a hydraulic medium to the interior 13. Furthermore, in the region of the opening 18, the outer tubular body is removed so that screwing to a tube or pipe (not shown) is possible. More specifically, in the embodiments shown in FIG. 2, both the outer tube and the connecting elements 5 are removed to above the opening 18.

A plurality of circumferential grooves 17, 19 are provided in the lower region 4*c* of the inner tubular body 4, on the inner circumference 4*a* thereof. These grooves are formed by turning. Sealing and guide rings (not shown) can be installed in the grooves 17, 19.

A cover 12 is arranged at the upper end of the lifting ram. This cover is connected, preferably by welding, to the inner tubular body 4. Furthermore, the cover is sunk in with respect to the upper face 7 of the lifting ram, so that any screwing-on of further elements is not hindered by the cover 12. Arranged in the cover is a vent hole 16 which has a threaded bore 16*a* and can be closed by a closure element (not shown). The vent hole 16 serves for venting the hydraulic system.

All the features disclosed in the application documents are claimed as essential to the invention in so far as they are novel individually or in combination with respect to the prior art.

LIST OF REFERENCES

1 lifting ram
3 outer tubular body
4 inner tubular body
4*a* inner wall of the inner tubular body 4
4*b* upper section of the inner tubular body
4*c* lower section of the inner tubular body
5*a*, 5*b* connecting elements
6 cavities
7 upper end face
8 lower end face
9 thread
11 cavity
12 cover
13 cavity between the connecting elements 5*a*, 5*b*
16 vent hole
16*a* thread of the vent hole
17, 19 circumferential grooves
18 opening
20 outer surface
M centre point
D pitch circle diameter

The invention claimed is:

1. A lifting ram for lifting platforms, comprising an inner tubular body and an outer body which is at least partially tubular and which at least partially surrounds the inner tubular body, wherein the outer tubular body and the inner tubular body are connected to one another at least in a force-fitting manner via connecting elements, and wherein the entire lifting ram is an extruded element whose inner tubular body has at least one essentially circumferential groove on its inner circumference in a lower region.

2. The lifting ram according to claim 1, wherein the inner tubular body has a plurality of circumferential grooves.

3. The lifting ram according to claim 1, wherein the outer tubular body and the inner tubular body are formed as one piece.

4. The lifting ram according to claim 1, wherein a thread is arranged in at least one end section of the lifting ram.

5. The lifting ram according to claim 1, wherein the inner tubular body is arranged for accommodating a piston element.

6. The lifting ram according to claim 1, wherein a covering element is arranged at an upper end of the lifting ram, which covering element covers the lifting ram in an essentially gastight manner.

7. The lifting ram according to claim 6, wherein a closable opening is arranged in the covering element.

8. The lifting ram according to claim 1, wherein an opening is provided in the inner tube above the grooves.

9. The lifting ram according to claim 1, further comprising at least one connecting element having a cavity extending in the longitudinal direction L of the lifting ram.

10. The lifting ram according to claim 9, wherein the at least one cavity has an essentially circular profile.

11. The lifting ram according to claim 1, wherein the connecting elements are formed as web elements.

12. The lifting ram according to claim 1, wherein the connecting elements are spaced apart from one another in the circumferential direction.

13. The lifting ram according to claim 1, wherein the lifting ram has an outer cross section selected from the group consisting of a circular cross section, an elliptical cross section, a polygonal cross section, and a combination thereof.

14. The lifting ram according to claim 13, wherein the polygonal cross section comprises a rectangular cross section.

15. A lifting device comprising a lifting ram according to claim 1.

16. The lifting device according to claim 15, wherein the lifting ram is arranged in a guide device at least in some sections.

17. The lifting device according to claim 15, wherein a hydraulic cylinder is arranged in the inner tubular body.

18. A lifting platform comprising at least one lifting device according to claim 15.

19. A lifting platform according to claim 18, wherein a load handling device is arranged on the at least one lifting device.

20. The lifting device according to claim 1, wherein sealing elements are arranged in the circumferential grooves of the inner tubular body.

21. The lifting device according to claim 1, wherein guide elements are arranged in the circumferential grooves of the inner tubular body.

22. A method for producing a lifting ram, wherein the entire lifting ram is produced by an extrusion process, wherein said lifting ram comprises an inner tubular body and an outer body which is at least partially tubular and which at least partially surrounds the inner tubular body, wherein the outer tubular body and the inner tubular body are connected to one another at least in a force-fitting manner via connecting elements, and wherein the inner tubular body has at least one essentially circumferential groove on its inner circumference in a lower region.

23. A lifting ram for lifting platforms, comprising an inner tubular body and an outer body which is at least partially tubular and which at least partially surrounds the inner tubular body, wherein the outer tubular body and the inner tubular body are connected to one another at least in a force-fitting manner via connecting elements, and wherein the outer tubular body has a smaller length than the inner tubular body.

24. The lifting ram according to claim 23, wherein the outer tubular body and the inner tubular body are formed as one piece.

25. The lifting ram according to claim 23, wherein a thread is arranged in at least one end section of the lifting ram.

26. The lifting ram according to claim 23, wherein the inner tubular body is arranged for accommodating a piston element.

27. The lifting ram according to claim 23, wherein a covering element is arranged at an upper end of the lifting ram, which covering element covers the lifting ram in an essentially gastight manner.

28. The lifting ram according to claim 27, wherein a closable opening is arranged in the covering element.

29. The lifting ram according to claim 23, wherein an opening is provided in the inner tube above the grooves.

30. The lifting ram according to claim 23, further comprising at least one connecting element having a cavity extending in the longitudinal direction L of the lifting ram.

31. The lifting ram according to claim 30, wherein the at least one cavity has an essentially circular profile.

32. The lifting ram according to claim 23, wherein the connecting elements are formed as web elements.

33. The lifting ram according to claim 23, wherein the connecting elements are spaced apart from one another in the circumferential direction.

34. The lifting ram according to claim 23, wherein the lifting ram has an outer cross section selected from the group consisting of a circular cross section, an elliptical cross section, a polygonal cross section, and a combination thereof.

35. The lifting ram according to claim 34, wherein the polygonal cross section comprises a rectangular cross section.

36. A lifting device comprising a lifting ram according to claim 23.

37. The lifting device according to claim 36, wherein the lifting ram is arranged in a guide device at least in some sections.

38. The lifting device according to claim 36, wherein a hydraulic cylinder is arranged in the inner tubular body.

39. A lifting platform comprising at least one lifting device according to claim 36.

40. A lifting platform according to claim 39, wherein a load handling device is arranged on the at least one lifting device.

41. The lifting device according to claim 23, wherein sealing elements are arranged in the circumferential grooves of the inner tubular body.

42. The lifting device according to claim 23, wherein guide elements are arranged in the circumferential grooves of the inner tubular body.

* * * * *